US012233444B2

(12) United States Patent
Ageba

(10) Patent No.: US 12,233,444 B2
(45) Date of Patent: Feb. 25, 2025

(54) PRESS FORMING TOOL AND PRESS FORMING METHOD

(71) Applicant: JFE STEEL CORPORATION, Tokyo (JP)

(72) Inventor: Ryo Ageba, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 320 days.

(21) Appl. No.: 17/925,961

(22) PCT Filed: Apr. 8, 2021

(86) PCT No.: PCT/JP2021/014848
§ 371 (c)(1),
(2) Date: Nov. 17, 2022

(87) PCT Pub. No.: WO2021/241025
PCT Pub. Date: Dec. 2, 2021

(65) Prior Publication Data

US 2023/0182189 A1 Jun. 15, 2023

(30) Foreign Application Priority Data

May 23, 2020 (JP) ..... 2020-090158

(51) Int. Cl.
*B21D 19/08* (2006.01)
*B21D 22/26* (2006.01)
(Continued)

(52) U.S. Cl.
CPC ..... *B21D 19/08* (2013.01); *B21D 22/26* (2013.01); *B21D 24/005* (2013.01); *B21D 53/88* (2013.01)

(58) Field of Classification Search
CPC ..... B21D 19/08; B21D 22/02; B21D 22/20; B21D 22/21; B21D 22/26; B21D 22/30; B21D 53/88
See application file for complete search history.

(56) References Cited

U.S. PATENT DOCUMENTS 11,731,185 B2 * 8/2023 Shinmiya ..... B21D 37/10 72/352
11,772,147 B2 * 10/2023 Tabata ..... B21D 19/08 72/362
(Continued)

FOREIGN PATENT DOCUMENTS

EP 3 476 500 A1 5/2019
JP S59-76625 A 5/1984
(Continued)

OTHER PUBLICATIONS

CN 107344191A, Gao Nov. 2017.*
(Continued)

*Primary Examiner* — Edward T Tolan
(74) *Attorney, Agent, or Firm* — Oliff PLC

(57) ABSTRACT

A press forming tool is configured to form a press forming part including: a top portion having a convex and concave outer edge part; and a flange portion. The press forming tool includes: an upper die and a lower die; and a lower pad and an upper pad, which sandwich a blank in cooperation with the upper die and the lower die, in which, during an initial stage of forming, the flange portion is formed on the convex outer edge part, and a torsional shape portion having a torsional shape toward the concave outer edge part is formed continuously from the flange portion, and during a late stage of forming, the torsional shape portion is formed into the flange portion, and the flange portion is formed in the concave outer edge part so as to achieve formation of a target shape.

2 Claims, 9 Drawing Sheets

(51) Int. Cl.

| | |
|---|---|
| ***B21D 24/00*** | (2006.01) |
| *B21D 53/88* | (2006.01) |

(56) References Cited

U.S. PATENT DOCUMENTS

| | | | | |
|---|---|---|---|---|
| 2016/0199897 | A1 | 7/2016 | Otsuka et al. | |
| 2018/0043413 | A1* | 2/2018 | Ueno | B21D 19/08 |
| 2021/0268566 | A1 | 9/2021 | Tabata et al. | |
| 2022/0080491 | A1* | 3/2022 | Fujimoto | B21D 5/06 |

FOREIGN PATENT DOCUMENTS

| | | | |
|---|---|---|---|
| JP | S60-210326 | A | 10/1985 |
| JP | S61-222640 | A | 10/1986 |
| JP | 2007-253173 | A | 10/2007 |
| JP | 6032374 | B2 | 11/2016 |
| JP | 2019-171440 | A | 10/2019 |
| WO | 2014/017436 | A1 | 1/2014 |
| WO | 2020/026356 | A1 | 2/2020 |

OTHER PUBLICATIONS

FR 3076472A1, Pain et al. Jul. 2019.*
Sep. 13, 2023 Extended Search Report issued in European Patent Application No. 21813956.6.
Jul. 6, 2021 International Search Report issued in International Patent Application No. PCT/JP2021/014848.

* cited by examiner

PRESS FORMING TOOL AND PRESS FORMING METHOD

FIELD

The present invention relates to a press forming tool (tools of press forming) and a press forming method applicable to press forming of a part such as an automotive part from a metal sheet, and particularly relates to a press forming tool and a method of press forming applicable to formation of a press forming part including a top portion having a convex and concave part in an in-plane direction; and a flange portion continuously formed from the top portion.

BACKGROUND

In recent years, in order to achieve weight reduction of automotive body due to environmental problems, high-strength steel sheets have been frequently used for automotive parts. However, a high-strength steel sheet is poor in elongation as compared with a steel sheet having low strength and thus tends to cause fracture during material processing. In addition, when a high-strength steel sheet is used, thinning of the sheet is also performed at the same time for further weight reduction, leading to a problem of high likelihood of occurrence of buckling of the steel sheet and occurrence of wrinkles during press forming. Therefore, development of a method of press forming for suppressing fracture and wrinkles is strongly required.

For example, Patent Literature 1 discloses a method of press forming that uses a wrinkle suppression pad (blank holder) driven separately from a punch and dies for press (dies) and makes it possible to manufacture an automotive part which is likely to cause wrinkles and stretch flange fractures inside a product with no forming defectiveness. The method disclosed in Patent Literature 1 is considered to be able to manufacture an automotive part that is likely to cause wrinkles and fractures inside a product without forming defectiveness.

CITATION LIST

Patent Literature

Patent Literature 1: JP 6032374 B2

SUMMARY

Technical Problem

However, the method of press forming disclosed in Patent Literature 1 is a method that needs to hold down the inside of the product away from the flange using a wrinkle suppression pad (blank holder). Therefore, the method has a problem that the technique cannot be applied to a shape having occurrence of wrinkles or fractures in the flange portion itself.

The present invention has been made in view of the above problem, and aims to provide a press forming tool and a method of press forming applicable to a press forming part having an occurrence of wrinkles and fractures in a flange itself and capable of simultaneously suppressing the wrinkles and fractures occurring the flange.

Solution to Problem

A press forming tool according to the present invention for forming a press forming part, the press forming part including: a top portion having a convex and concave outer edge part in which a convex outer edge part protruding outward in an in-plane direction and a concave outer edge part recessed inward in the in-plane direction are continuous to each other via a connecting outer edge part; and a flange portion continuously formed in the convex and concave outer edge part of the top portion, includes: an upper die and a lower die to be used for bend-forming of the flange portion along the convex and concave outer edge part; and a lower pad and an upper pad configured to sandwich a blank in cooperation with the upper die and the lower die, wherein the upper die includes: a convex outer edge flange forming portion configured to form the flange portion in the convex outer edge part; a concave outer edge flange forming portion configured to form the flange portion in the concave outer edge part; and a connecting outer edge flange forming portion configured to form the flange portion in the connecting outer edge part, the convex outer edge flange forming portion protruding in a press forming direction from the concave outer edge flange forming portion, with the connecting outer edge flange forming portion inclined from the convex outer edge flange forming portion toward the concave outer edge flange forming portion, the lower pad has a shape corresponding to each of the convex outer edge flange forming portion, the concave outer edge flange forming portion, and the connecting outer edge flange forming portion formed in the upper die, and press forming is performed such that during an initial stage of forming, the flange portion is formed on the convex outer edge part by the convex outer edge flange forming portion, and a torsional shape portion having a torsional shape toward the concave outer edge part is formed continuously from the flange portion by the connecting outer edge flange forming portion, and during a late stage of forming, the torsional shape portion is formed into the flange portion by the connecting outer edge flange forming portion, and the flange portion is formed in the concave outer edge part by the concave outer edge flange forming portion so as to achieve formation of a target shape.

A method of press forming according to the present invention for forming a press forming part by using the press forming tool according to the present invention, the press forming part including: a top portion having a convex and concave outer edge part in which a convex outer edge part protruding outward in an in-plane direction and a concave outer edge part recessed inward in the in-plane direction are continuous to each other via a connecting outer edge part; and a flange portion continuously formed on the convex and concave outer edge part of the top portion, includes: an initial forming step of forming the flange portion in the convex outer edge part by the convex outer edge flange forming portion and forming a torsional shape portion having a torsional shape toward the concave outer edge part by the connecting outer edge flange forming portion so as to be continuous from the flange portion, by moving the upper die in a press forming direction in a state where a part of a blank is sandwiched by the upper pad and the lower die and a part of the blank is supported by the lower pad; and a late forming step of moving the upper die and the lower pad in the press forming direction to form the torsional shape portion into the flange portion by the connecting outer edge flange forming portion and to form the flange portion in the concave outer edge part by the concave outer edge flange forming portion so as to achieve formation of a target shape.

Advantageous Effects of Invention

The press forming tool of the present invention is applicable to a press forming part having an occurrence of wrinkles and fractures in a flange itself and is capable of simultaneously suppressing wrinkles and fractures occurring in the flange. In addition, it is possible to press forming using dies by a single action with a movement in a single direction, and leading to achievement of press forming with high efficiency.

DESCRIPTION OF EMBODIMENTS

Figure 14:
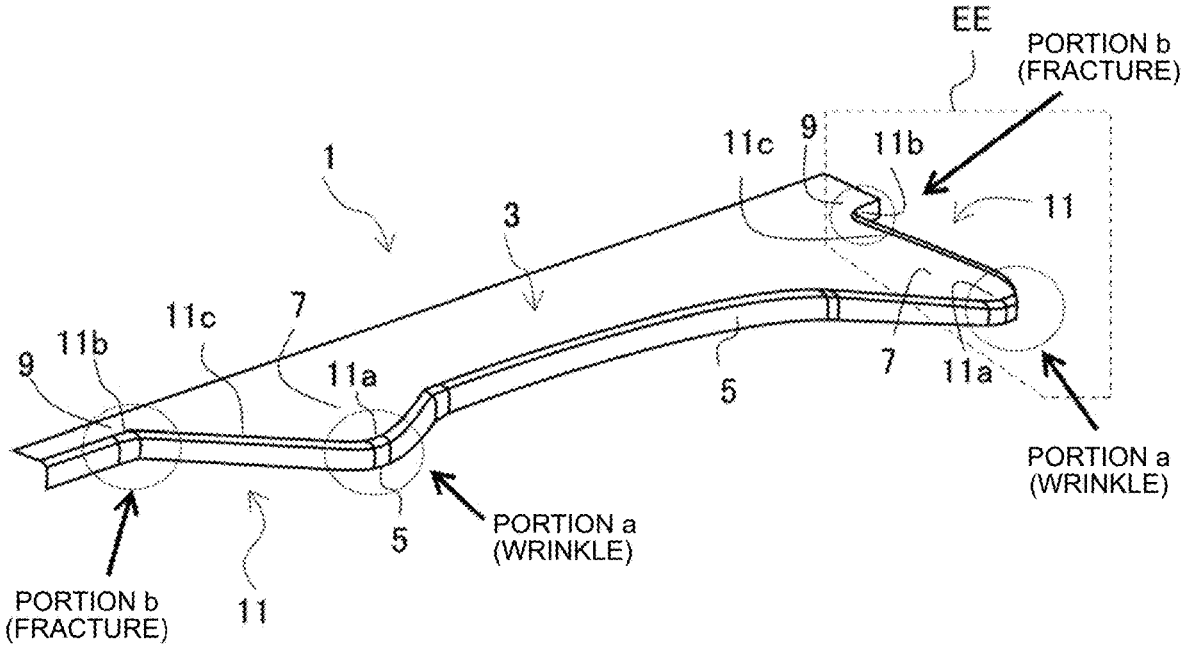
FIG. 14 is a view illustrating a target shape and a problem occurring in a forming process of the target shape according to the embodiment.

Prior to the description of the press forming tool and the method of press forming according to the present embodiment, an example of a press forming part to be formed in the present invention will be described with reference to FIGS. 14 and 15. If press forming part 1 illustrated in FIG. 14 is drawn as a perspective view of a slide door rail which is an automotive part, and includes a top portion 3 and a flange portion 5. The top portion 3 has a convex part 7 protruding outward in an in-plane direction and a concave part 9 adjacent to the convex part 7 and recessed inward in the in-plane direction. The outer periphery of the top portion 3 is formed to be a convex and concave outer edge part 11 including: a convex outer edge part 11*a* which is an outer peripheral side of the convex part 7; a concave outer edge part 11*b* which is an outer peripheral side of the concave part 9: and a connecting outer edge part 11*b* connecting the convex of edge part 11*a* and the concave outer edge part 11*b* to each other. The flange portion 5 is formed on the convex and concave outer edge part 11. In the case of an actual slide door rail, a bent portion is formed on an outer edge part of the top portion 3 facing the convex and concave outer edge part 11 where the flange portion 5 is formed. However, FIG. 14 omits illustration of the bent portion.

When such a press forming part 1 is formed by a conventional method of press forming, the flange portion 5 formed in the convex outer edge part 11*a* subjected to shrink flange forming (portion a circled by a broken line in the drawing), and wrinkles are likely to occur due to the excess metal. On the other hand, the flange portion 5 formed in the concave outer edge part 11*b* is subjected to stretch flange forming (portion b circled by a broken line in the drawing), and is likely to have fractures due to a material shortage.

A mechanism of occurrence of the wrinkles and the fractures will be described with reference to FIG. 15. FIG. 15 is a diagram illustrating a material flow in the forming process in portion EE surrounded by the broken line in FIG. 14, illustrating a top view (FIG. 15(*a*)) and a side view of (FIG. 15(*b*)) of FIG. 14. In FIG. 15, a broken line is a tip of the blank before forming, and a solid line is an edge of the flange portion 5 formed into a target shape. Further, points D and B in the drawing are points corresponding to the R-finish (the boundary between a curve and a straight line) of the convex outer edge part 11*a* n the blank before forming, and corresponding intersections of lines perpendicular to the edge of the target shape from points D and B in the top view and the edge of the target shape are points D' and B'. Similarly, points A and E in the drawing are points corresponding to the R-finish of the concave outer edge part 11*b* in the blank before forming, and corresponding points of intersection between a line perpendicular to the edge of the target shape from points E and A in the top view and the edge of the target shape are points A' and E'. As illustrated in the top view of FIG. 15(*a*), since the material flows substantially perpendicularly to the ridge line (bending line), the material flows in a direction in which the material gathers in portion a, and flows in a direction in which the material leaves in portion b. Accordingly, wrinkles are likely to occur in portion a, while fractures are likely to occur in portion b.

In order to solve such a problem, the inventors have considered that interposing a preformed part, which facilitates inflow of a material from a portion where shrink flange forming occurs to a portion where stretch flange forming occurs, in the middle of forming will enable avoidance of concentration of compressive strain and tensile strain in each of the portions, and have devised a press forming tool that can achieve this method of press forming. Specifically, the press forming tool has the following configuration.

As illustrated in FIG. 14, for example, a press forming tool 13 according to the present embodiment forms a press forming part 1 including: atop portion 3 having a convex and concave outer edge part 11 in which a convex outer edge part 11*a* protruding outward in an in-plane direction and a concave outer edge part 11*b* recessed inward in the in-plane direction are continuous to each other via a connecting outer edge part 11*c*; and a flange portion 5 continuously formed on the convex and concave outer edge part 11 of the top portion 3. Further, as illustrated in FIGS. 1 to 4, le press forming tool 13 according to the present embodiment includes: an upper die 15 and a lower die 17 for bend-forming the flange portion 5 along the convex and concave outer edge part 11 (FIG. 5); and a lower pad 21 and an upper pad 23 that sandwich a blank 19 in cooperation with the upper die 15 and the lower die 17. Note that terms of the upper and lower in the upper die and the lower die just indicate a relative relationship, and thus, the positions are not necessarily upper or lower, but simply indicate that they are provided in a pair. With the press forming tool 13 of the present embodiment, the blank 19 (FIG. 6) is placed on the lower die 17 and sandwiched by the upper pad 23, and the upper die 15 and the lower pad 21 are moved to perform bend-forming of the flange portion 5 at an outer edge of the blank 19. The bending edge portions of the upper die 15 and the lower die 17 are formed with convex and concave outer surfaces that protrude or recesses in the in-plane direction of the blank 19 to be placed, similarly to the convex and concave outer parts 11 of the top portion 3.

Figure 1:
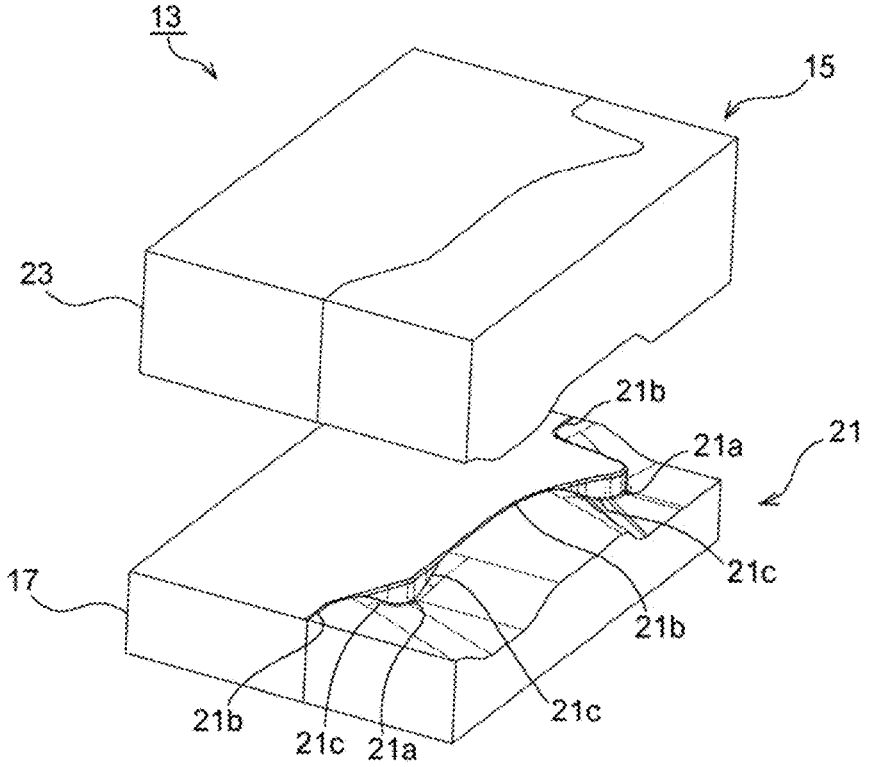
FIG. 1 is a view illustrating a press forming tool according to an embodiment of the present invention (part 1).
Figure 2:
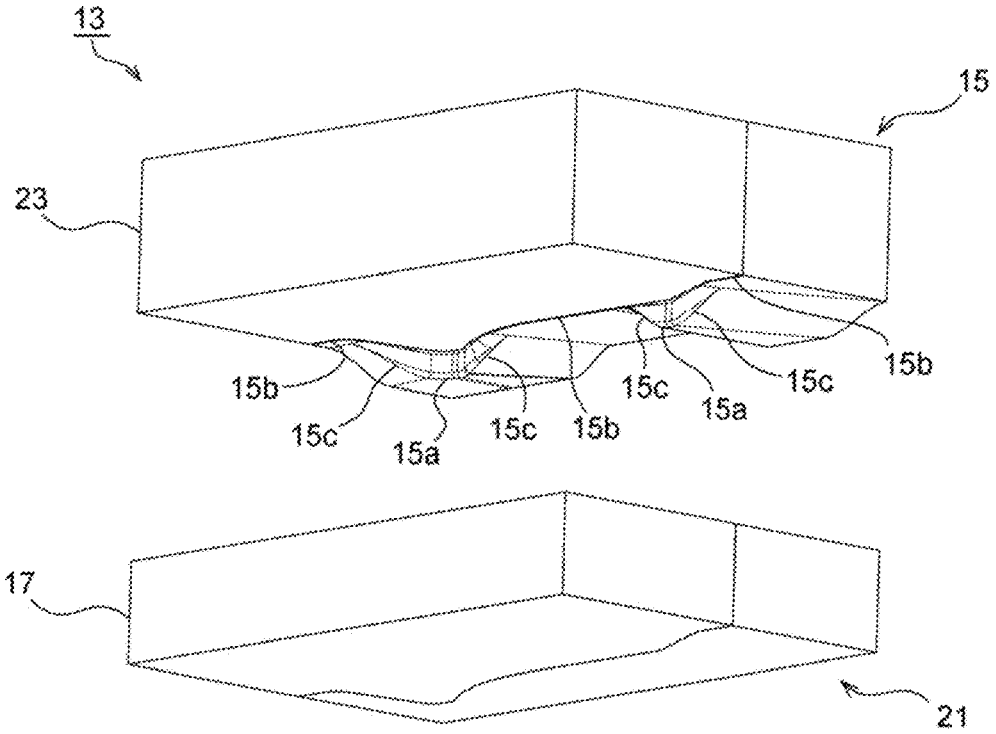
FIG. 2 is a view illustrating the press forming tool according to the embodiment of the present invention (part 2).
Figure 3:
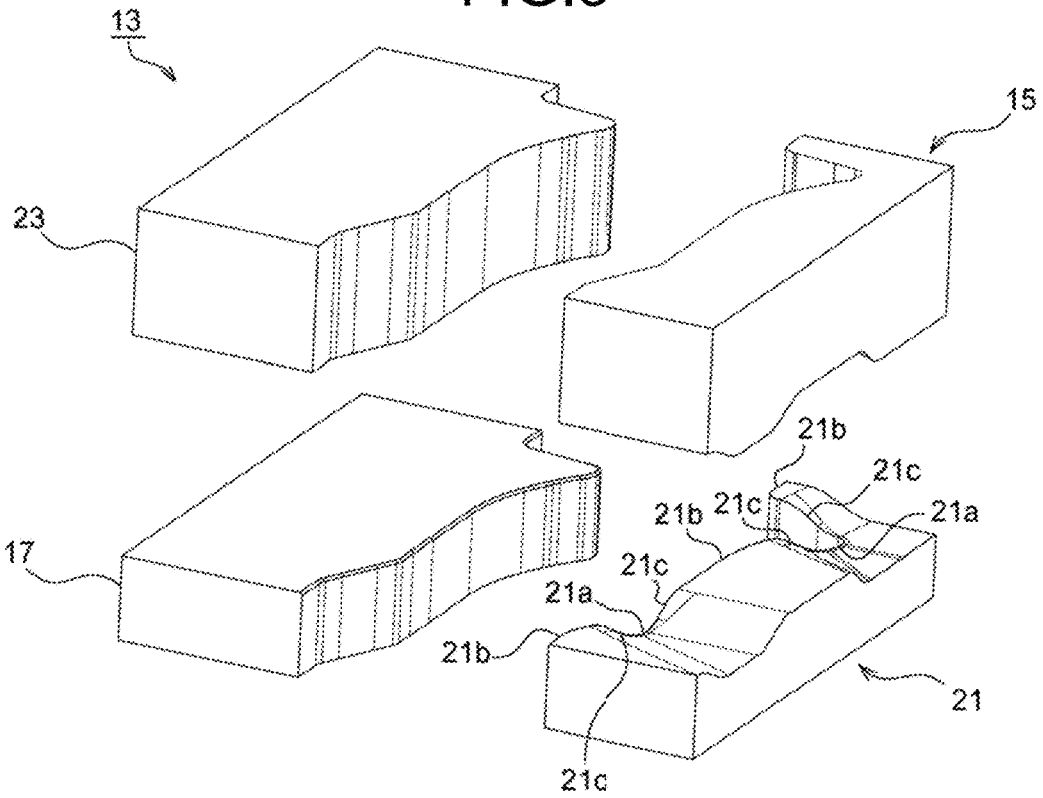
FIG. 3 is a view illustrating the press forming tool according to the embodiment of the present invention (part 3).
Figure 4:
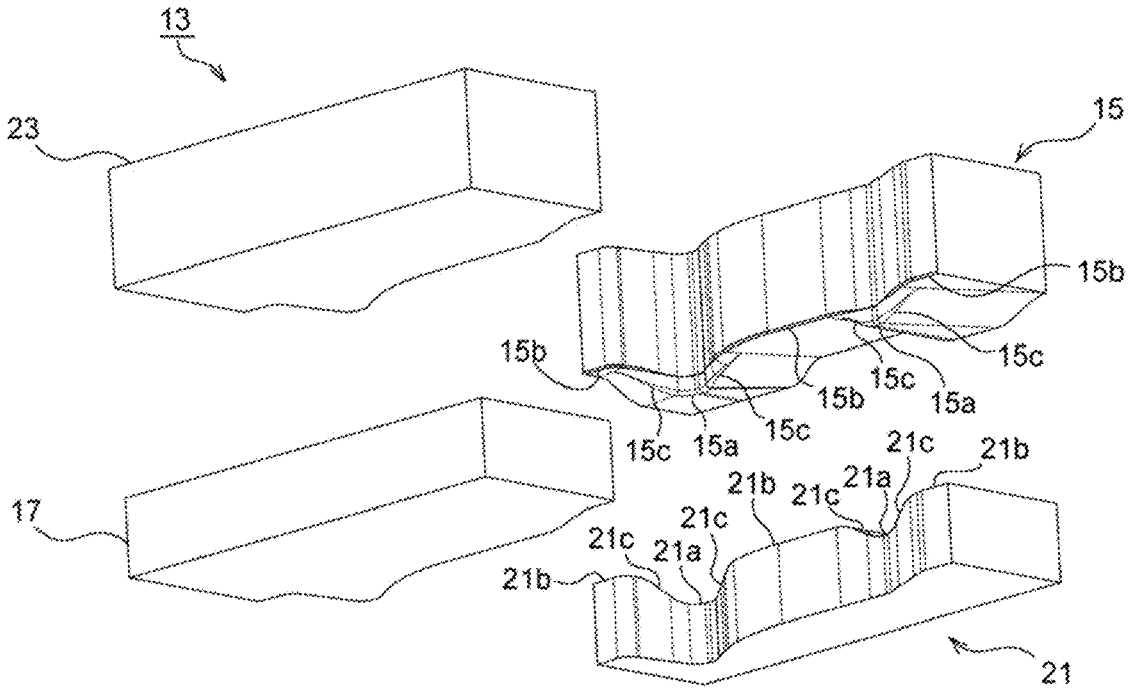
FIG. 4 is a view illustrating the press forming tool according to the embodiment of the present invention (part 4).

The upper die 15 includes: a convex outer edge flange forming portion 15*a* that forms the flange portion 5 the convex outer edge part 11*a*; a concave outer edge flange forming portion 15*b* that forms the flange portion 5 in the concave outer edge part 11*b*; and a connecting outer edge flange forming portion 15*c* that forms the flange portion 5 in the connecting outer edge part 11*c* (refer to FIG. 4). The convex outer edge flange forming portion 15*a* protrudes in the press forming direction (downward in FIGS. 1 to 4 in the out-of-plane direction of the blank 19 to be placed) from the concave outer edge flange forming portion 15*b*, while the connecting outer edge flange forming portion 15*c* is inclined from the convex outer edge flange forming portion 15*a* toward the concave outer edge flange forming portion 15*b* (refer to FIGS. 2 and 4).

The lower pad 21 has a shape corresponding to each of the convex outer edge flange forming portion 15*a*, the concave of edge flange forming portion 15*b*, and the connecting outer edge flange forming portion 15*c* formed in the upper die 15. That is, a portion of the lower pad 21 corresponding to the convex outer edge flange forming portion 15*a* of the upper die 15 (the portion also referred to as a lower pad convex outer edge flange forming portion 21*a*) is more recessed in the press forming direction compared with a portion corresponding to the concave outer edge flange forming portion 15*b* of the upper die 15 (the portion also referred to as a lower pad concave outer edge flange forming portion 21*b*). Moreover, a portion corresponding to the connecting outer edge flange forming portion 15*c* of the upper die 15 (the portion also referred to as a lower pad connecting outer edge flange forming portion 21*c*) is inclined from the lower pad concave outer edge flange forming portion 21*b* toward the lower pad convex outer edge flange forming portion 21*a* (refer to FIGS. 1 and 3).

Figure 5:
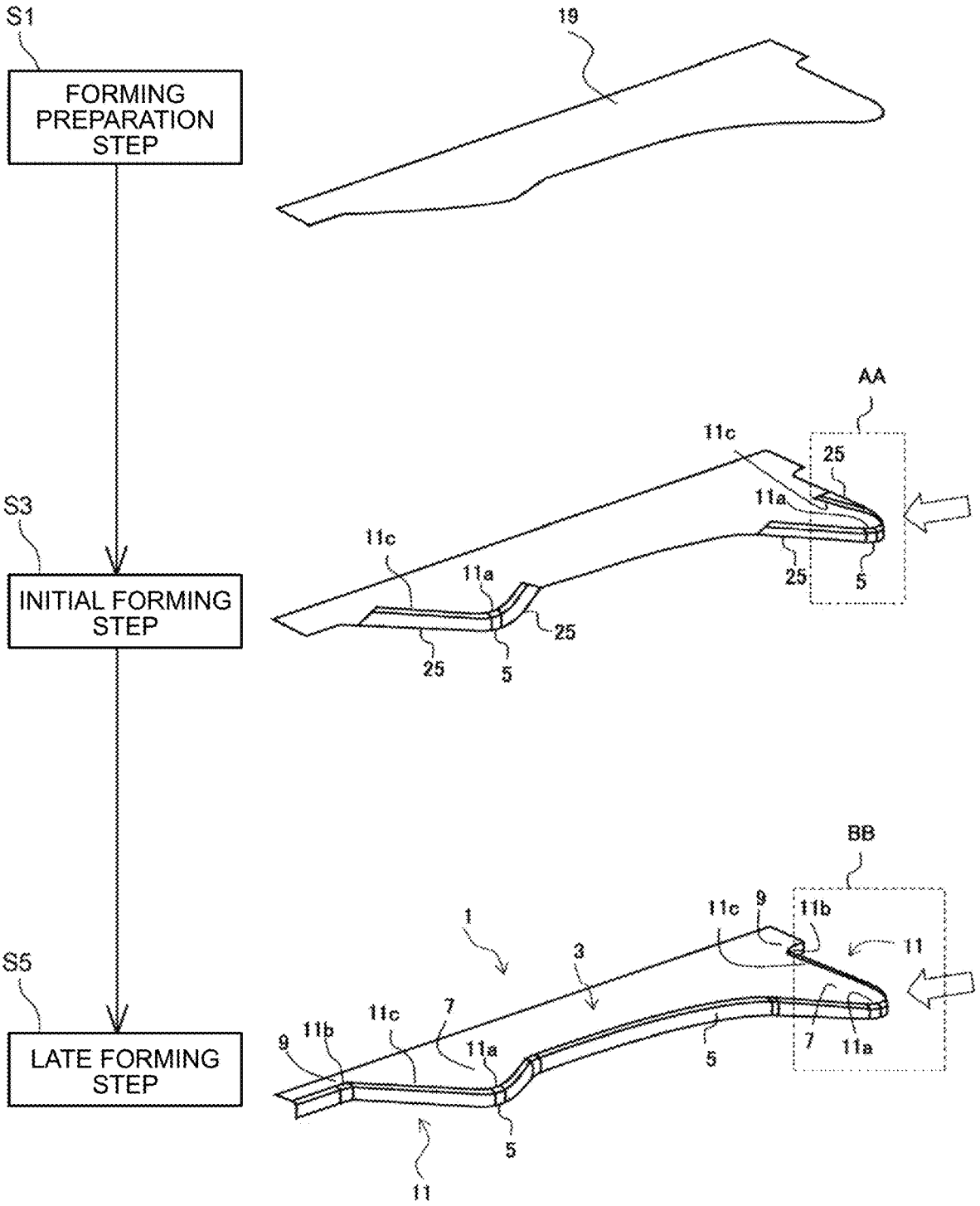
FIG. 5 is a view illustrating a method of press forming according to the embodiment of the present invention.
Figure 10:
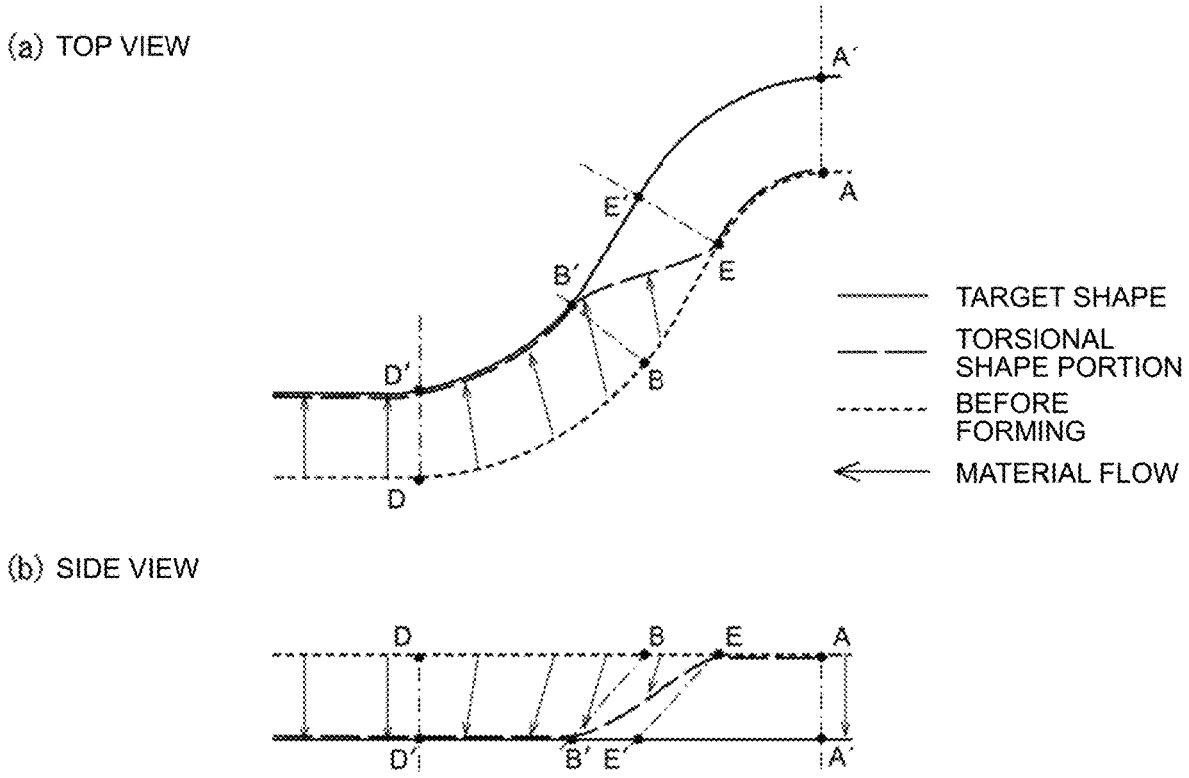
FIG. 10 is a view illustrating a mechanism of suppressing occurrence of wrinkles in the initial forming step.
Figure 11:
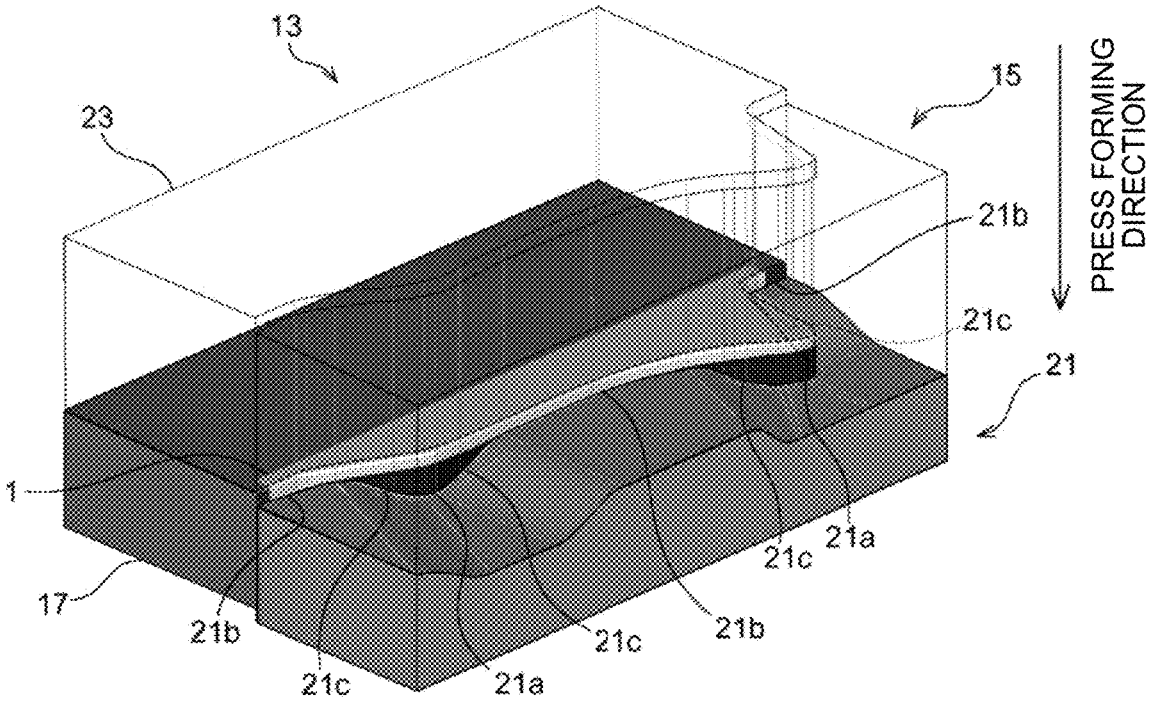
FIG. 11 is a view illustrating states of dies in a late forming step of the method of press forming according to the embodiment of the present invention.

Next, a method of forming the slide door rail member illustrated in FIG. 14 using the above-described a press forming tool 13 of the present embodiment will be described. As illustrated in FIG. 5, the method of press forming of the present embodiment includes a forming preparation step S1 of setting the blank 19 in the press forming tool 13, an initial forming step S3, and a late forming step S5. Hereinafter, each step will be described in detail with reference to FIGS. 5 to 13. In FIGS. 7, 8, and 11 illustrating the movement of the dies, the upper die 15 and the upper pad 23 are drawn as transparent perspective views in order to demonstrate the forming state of the blank 19.

Forming Preparation Step

Figure 6:
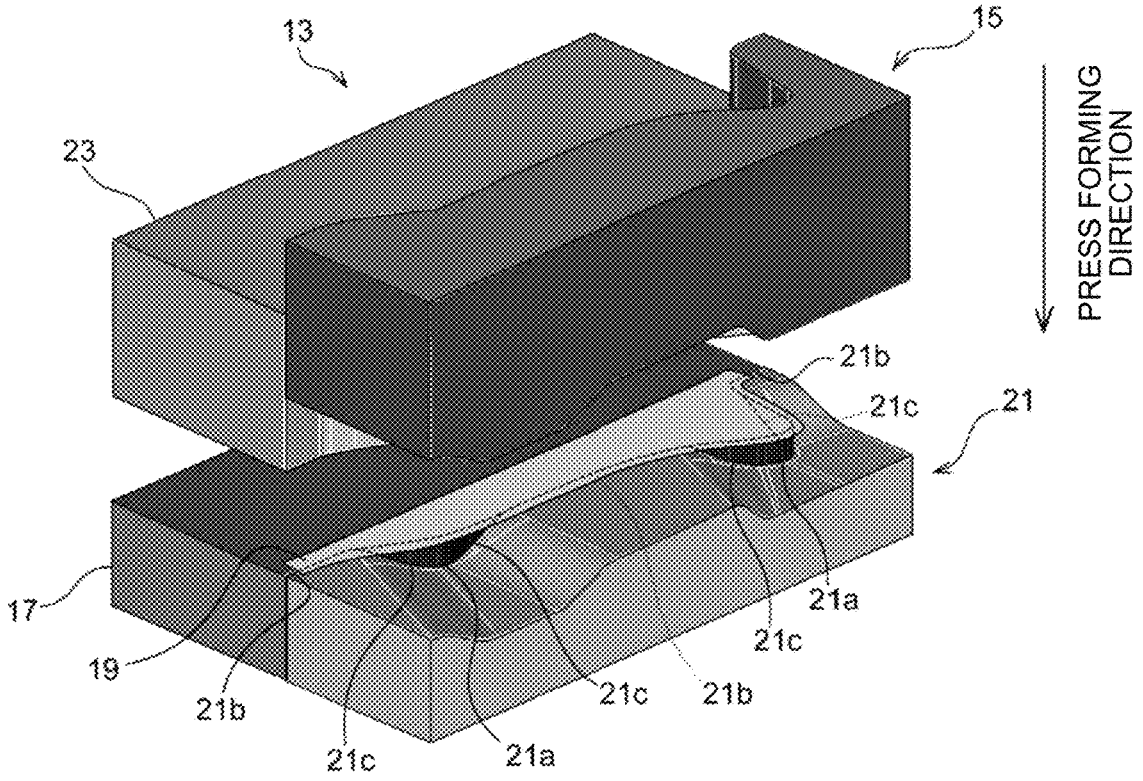
FIG. 6 is a view illustrating states of dies in a forming preparation step of the method of press forming according to the embodiment of the present invention (part 1).
Figure 7:
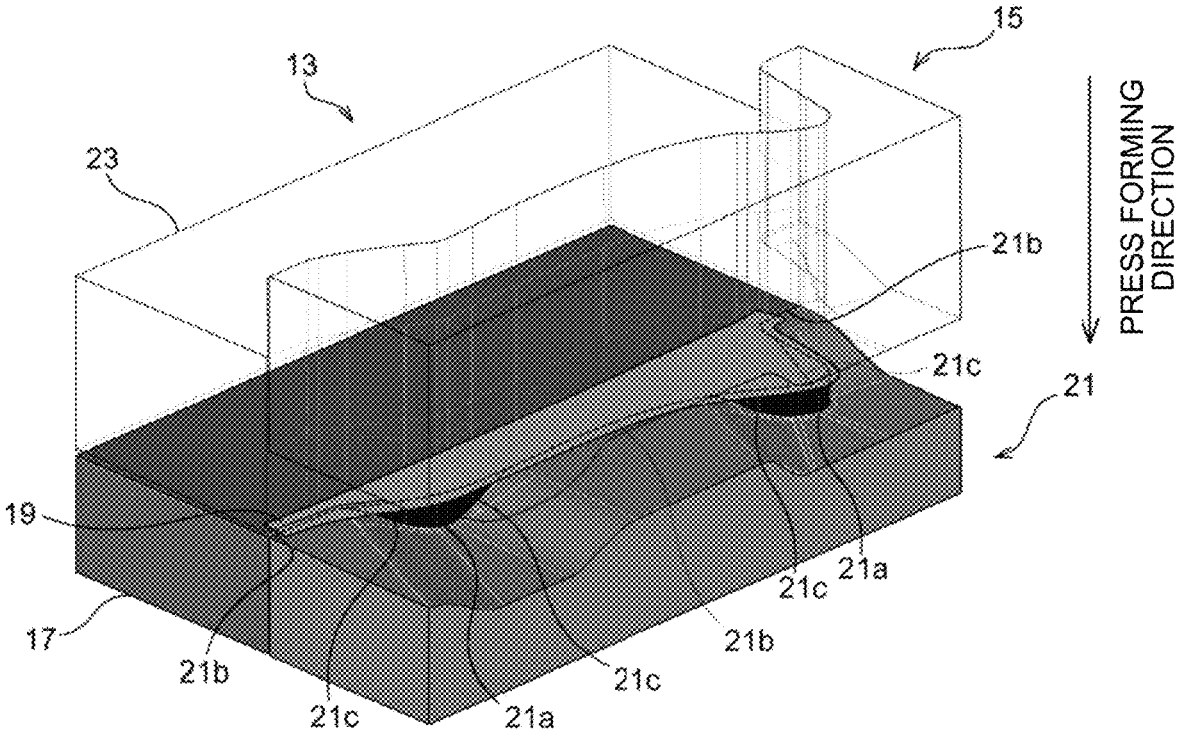
FIG. 7 is a view illustrating states of dies in the forming preparation step of the method of press forming according to the embodiment of the present invention (part 2).
Figure 8:
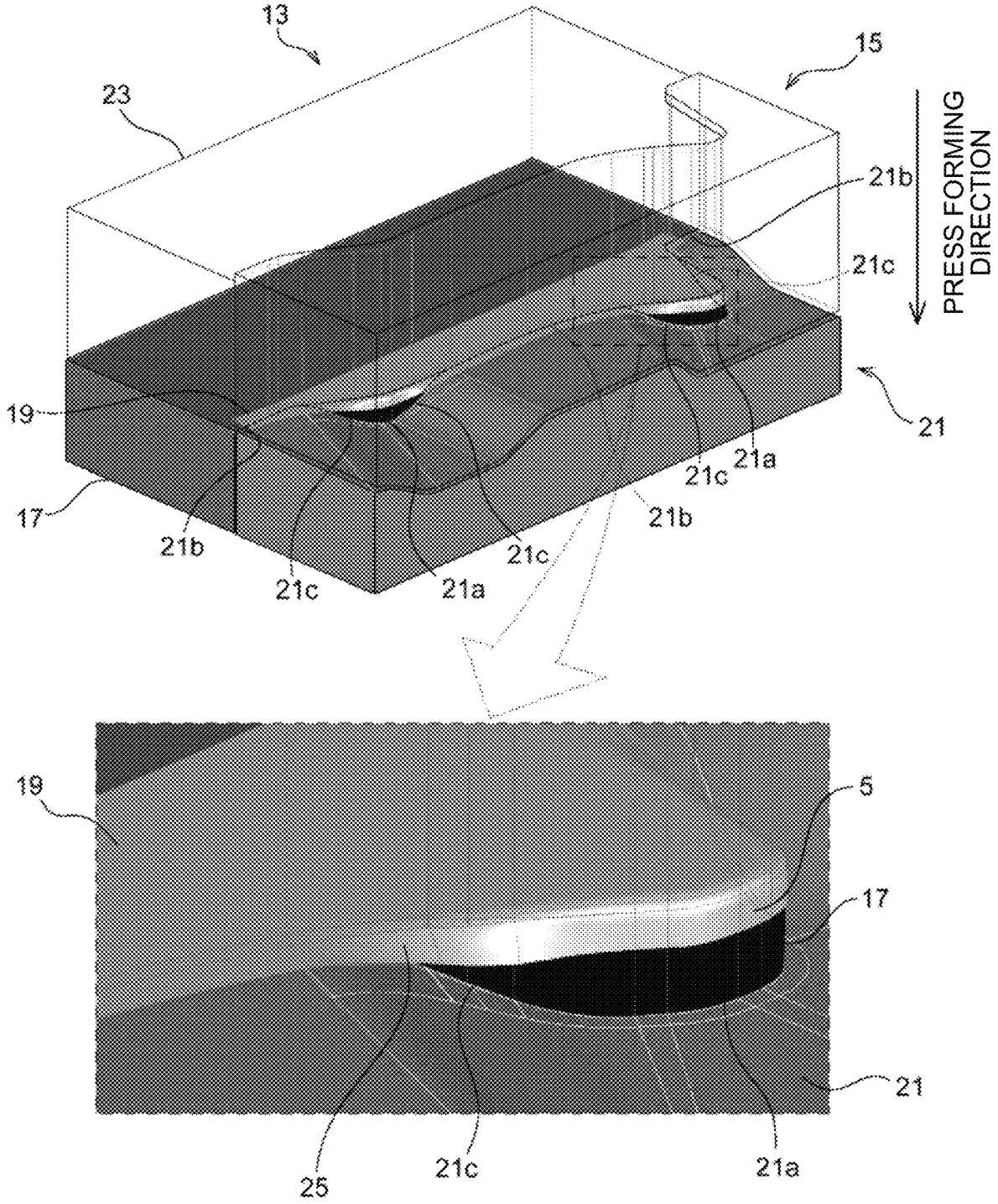
FIG. 8 is a view illustrating states of dies in an initial forming step of the method of press forming according to the embodiment of the present invention.

In the forming preparation step S1, as illustrated in FIG. 6, a blank 19 made of a metal sheet is placed on the lower die 17, and as illustrated in FIG. 7, a part of the blank 19 is sandwiched by using the upper pad 23. At this time, the uppermost surface (for example, the lower pad concave outer edge flange forming portion 21*b*) of the lower pad 21 is flush with the upper surface of lower die 17. A portion of the blank 19 corresponding to the top portion 3 is disposed on the lower die 17, while a portion of the blank 19 corresponding to the flange portion 5 is disposed on the lower pad concave outer edge flange forming portion 21*b* of the lower pad 21.

Initial Forming Step

In the initial forming step S3, as illustrated in FIG. 8, a part of the blank 19 is supported by the lower pad 21 in a state where a part of the blank 19 is sandwiched between the upper pad 23 and the lower die 17, and the upper die 15 is relatively moved in the press forming direction. With this operation, the flange portion 5 is formed in the convex outer edge part 11*a* by the convex outer edge flange forming portion 15*a*, and a torsional shape portion 25 having a shape torsional toward the concave outer edge part 11*b* is formed by the connecting outer edge flange forming portion 15*c* continuously from the flange portion 5.

Figure 9:
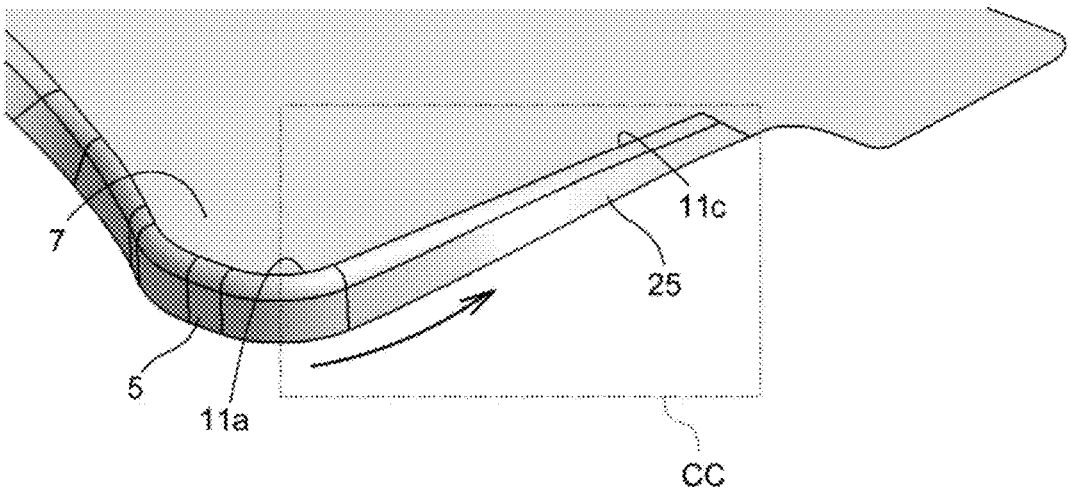
FIG. 9 is an enlarged view of portion AA in the formed part in the initial forming step in FIG. 5 as viewed from a direction of a thick arrow.

In the initial forming step S3, the flange portion 5 is formed in the convex outer edge part 11*a* of the top portion 3, but since the concave outer edge part 11*b* is supported by the lower pad concave outer edge flange forming portion 21*b*, the flange portion 5 is not formed in the concave outer edge part 11*b* of the top portion 3. Therefore, instead of the flange portion 5, the torsional shape portion 25 is formed on the connecting outer edge part 11*c* ranging from the convex outer edge part 11*a* to the concave outer edge part 11*b*. As illustrated in FIG. 9, the torsional shape portion 25 is connected, on one end side, to the flange portion 5 formed on the convex outer edge part 11*a*, while being connected, the other end side, to the top portion 3 as a flat portion, forming the torsional shape portion 25 to have a torsional shape. At the time of forming the torsional shape portion 25, as indicated by an arrow in FIG. 9, a metal inflow occurs in a direction from the flange portion 5 side to be formed toward the flat portion, leading to alleviation of excess metal in the shrink flange forming and suppression of the occurrence of wrinkles.

A mechanism of occurrence of the material flow will be described with reference to FIG. 10. FIG. 10 is a view illustrating the material flow in the forming process of portion CC surrounded by the broken line in FIG. 9, illustrating a top view and a side view of FIG. 9. In FIG. 10, a fine broken line is an edge of the blank before forming, a coarse broken line is an edge of the torsional shape portion 25, and a solid line is an edge of the target shape. Points A to E and points A' to E' in the drawing are the same as those illustrated in FIG. 15. That is, point A in the drawing is an R-finish of a curved portion in the blank 19, and is a tip position of the torsional shape portion 25 with little deformation. Point B is a point corresponding to one R-finish of the blank portion having occurrence of shrink flange forming in a conventional case, and point B' is an intersection of a line extending perpendicularly to the edge of the torsional shape portion 25 from point B in the top view and the edge of the torsional shape portion 25. Point D is an R-finish of the curved portion of the blank 19, and point D' is an intersection of a line perpendicular to the edge of the target shape from point D in the top view and the edge of the target shape.

Due to the shrink flange forming, the distance from point B' to point D' is shorter than the distance from point B to point D (B'D'<BD), and thus, wrinkles are likely to occur in the flange portion 5 formed in the convex outer edge part 11*c* due to the excess metal. On the other hand, since the distance from point A to point B' is longer than the distance from point A to point B (AB'>AB) in a three-dimensional view, the material is pulled toward point A and flows while deviating from "substantially perpendicular to the ridge line". Therefore, the material flow indicated by the arrow in FIG. 10 is generated, the material flow being closer to point A as compared with the conventional material flow indicated by the arrow in the wrinkle occurrence region in FIG. 15. This material flow alleviates the excess metal in shrink flange forming during the initial forming step, leading to suppressing of occurrence of wrinkles.

Late Forming Step

In the late forming step S5, as illustrated in FIG. 11, the upper die 15 and the lower pad 21 are moved in the press forming direction. With this operation, the torsional shape portion 25 is formed into the flange portion 5 by the connecting outer edge flange forming portion 15*c*, while the flange portion 5 is formed in the concave outer edge part 11*b* by the concave outer edge flange forming portion 15*b*, achieving forming of the target shape. In the forming process of the late forming step S5, as indicated by a thick arrow in FIG. 12, the metal inflow occurs from the torsional shape portion 25 to the stretch flange forming portion, leading to alleviation of material shortage in the stretch flange forming portion and suppression of the occurrence of fractures.

Figure 12:
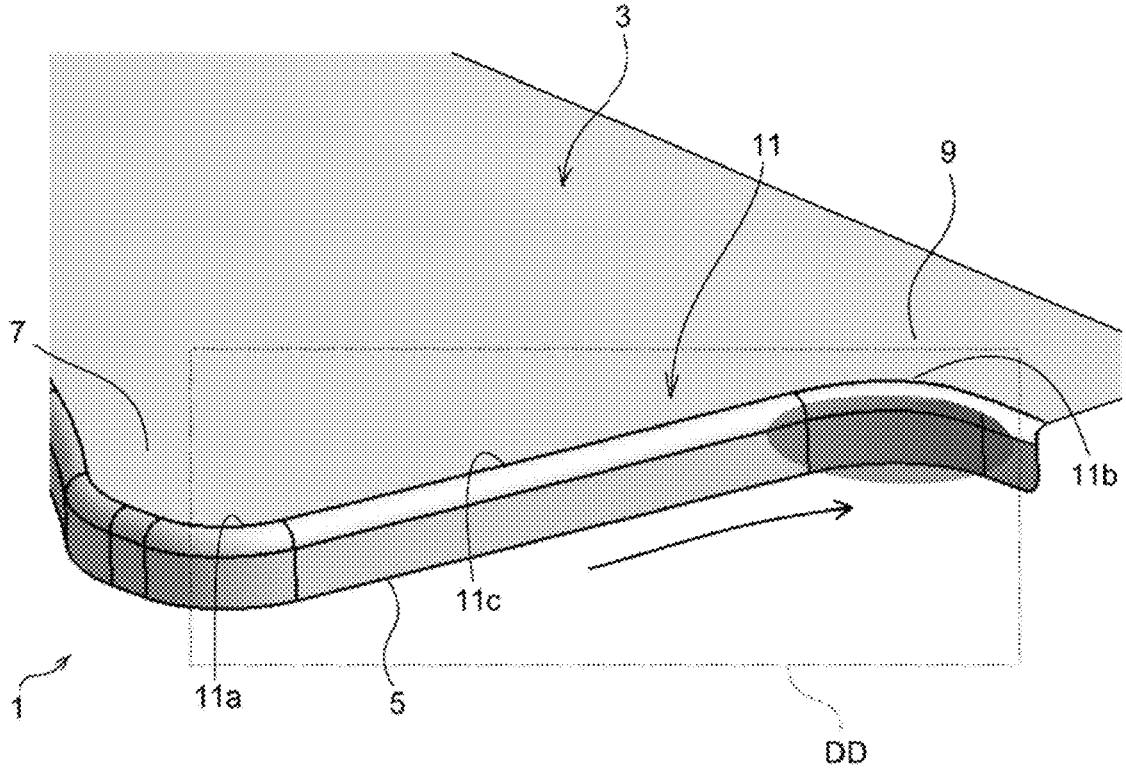
FIG. 12 is an enlarged view of portion BB in a target shape in the late forming step of FIG. 5 as viewed from the direction of a thick arrow.
Figure 13:
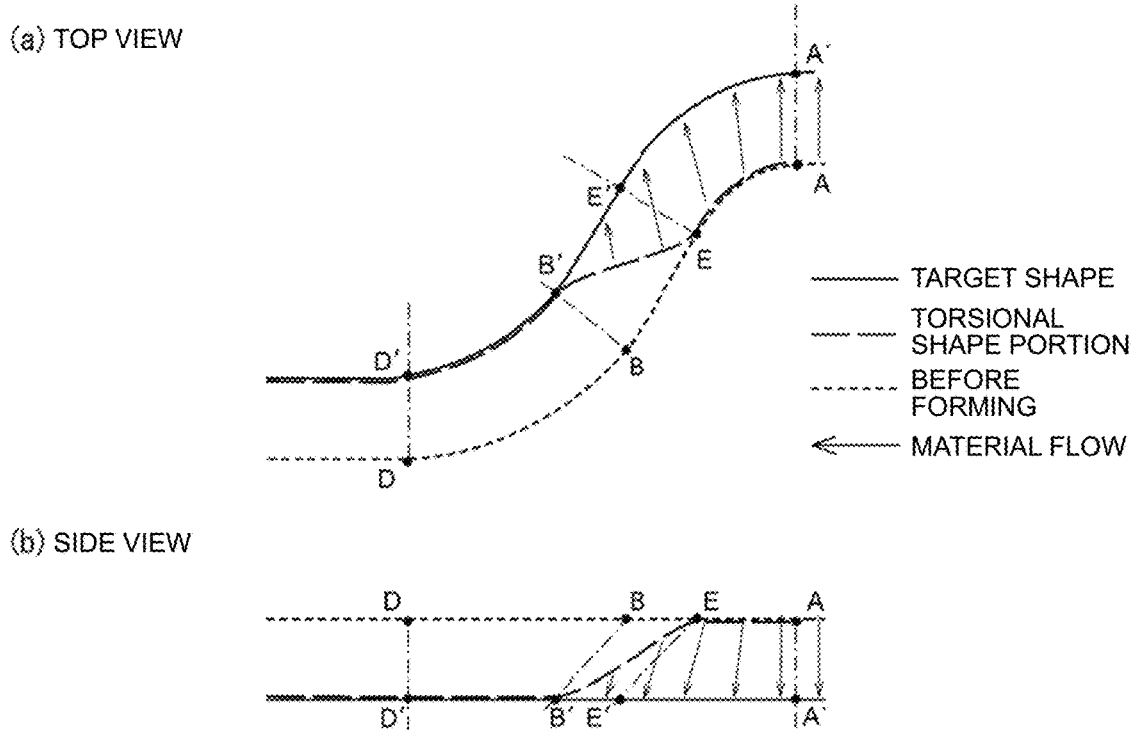
FIG. 13 is a view illustrating a mechanism of suppressing occurrence of fractures in the late forming step.

A mechanism of occurrence of the material flow will be described with reference to FIG. 13. FIG. 13 is a view illustrating the material flow in the forming process of portion DD surrounded by the broken line in FIG. 12, illustrating a top view and a side view of FIG. 12. In FIG. 13, a fine broken line is an edge of the blank before forming, a coarse broken line is an edge of the torsional shape portion 25, and a solid line is an edge of the flange portion 5 in the target shape.

Figure 15:
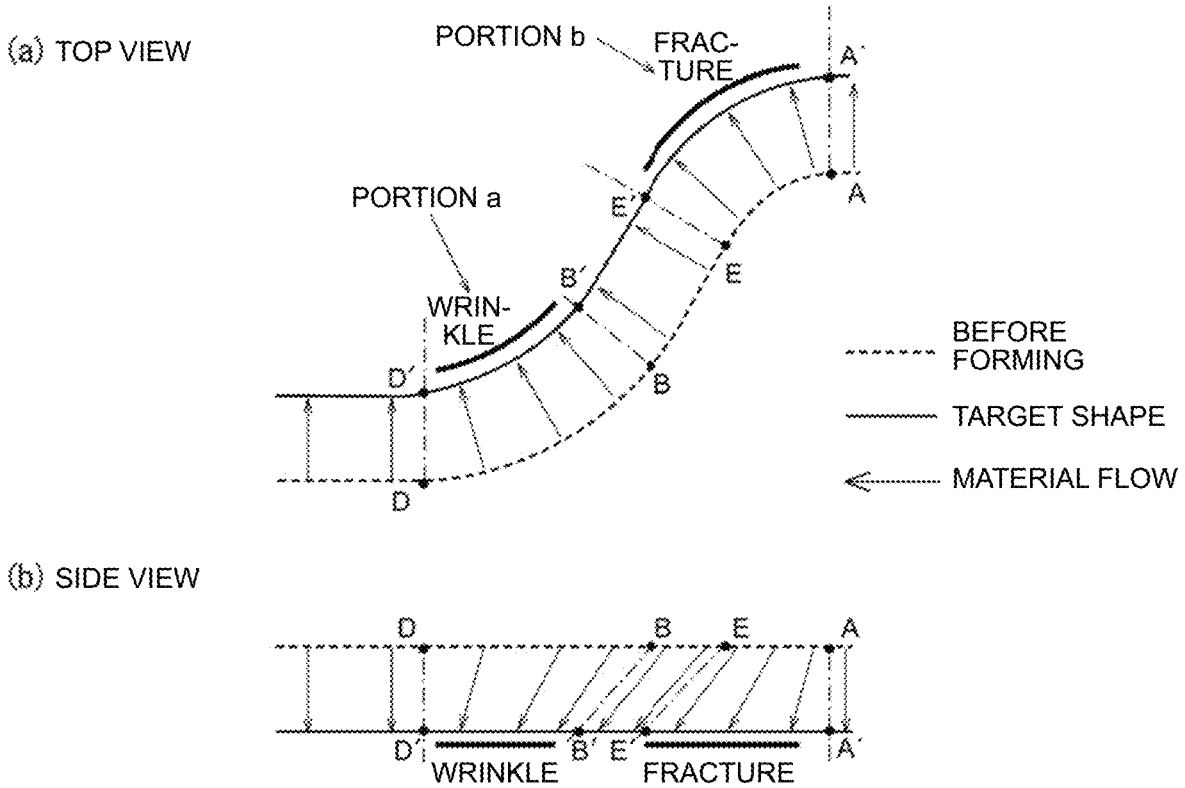
FIG. 15 is a diagram illustrating a mechanism of occurrence of wrinkles and fractures in the forming process of the target shape illustrated in FIG. 14.

In addition, points A to E and points A' to E' in the drawing are the same as those illustrated in FIGS. 15 and 10. That is, point A' in the drawing is an intersection of a line extending perpendicularly to the ridge line of the target shape in the top view from point A and the target shape. Point E is a point corresponding to one R-finish of the blank portion in which the conventional stretch flange forming occurs, and point E' is an intersection of a line perpendicular to the edge of the target shape from point E in the top view and the edge of the target shape. Due to the stretch flange forming, the distance from point A' to point E' is longer than the distance from point A to point E (A'E'>AE), and the material shortage is likely to cause an occurrence of fractures in the flange portion 5 formed in the concave outer edge part 11*b*. On the other hand, since the distance from point D' to point E' is shorter than the distance from point D' to point E (D'E'<D'E) in a three-dimensional view, the material is pushed toward the A' side and flows while deviating from "substantially perpendicular to the ridge line". Therefore, the material flow indicated by the arrow in FIG. 13 is generated, the material flow being closer to point A' as compared with the conventional material flow indicated by the arrow in the fracture occurrence region in FIG. 15. This material flow alleviates the material shortage in the stretch flange forming during the late forming step S5, leading to suppression of occurrence of fractures.

As described above, with the press forming tool 13 of the present embodiment, it is possible to form, during the initial stage of forming, the flange portion 5 in the convex outer edge part 11*a* by the convex outer edge flange forming portion 15*a* and form the torsional shape portion 25 having a torsional shape toward the concave outer edge part 11*b* continuously from the flange portion 5 by the connecting outer edge flange forming portion 15*c*, and possible to form, during the late stage of forming, the torsional shape portion 25 into the flange portion 5 by the connecting outer edge flange forming portion 15*c* and form the flange portion 5 in the concave outer edge part 11*b* by the concave outer edge flange forming portion 15*b*, achieving formation of the target shape. With this configuration, the torsional shape portion 25 that promotes the material flow to the portion side occurrence of the stretch flange forming is formed by first forming only the portion of occurrence of the shrink flange forming during the initial stage of forming, and target shape can be formed by suppressing the material shortage due to the stretch flange forming by the material flow from the torsional shape portion 25 by forming the portion of occurrence of the stretch flange forming during the late stage of forming.

In this manner, by dispersing the strain or a dangerous portion where the stretch flange fracture occurs and a dangerous portion where the shrink flange wrinkles occur, it is possible to suppress the occurrence of wrinkles due to shrink flange forming in the initial forming step S3, suppress occurrence of fractures due to the stretch flange forming in the late forming step S5, and suppress the occurrence of wrinkles and fractures throughout all the steps. In addition, it is possible to press forming using dies by a single action with a movement in a single direction, and leading to achievement of press forming with high efficiency.

EXAMPLE

In order to confirm the effect of the present invention, press forming was performed with an example of a slide door rail member as illustrated in FIG. 14 as a target shape. The material was a steel sheet having a tensile strength of 1180 MPa class and a thickness of 1.4 mm. First, as Comparative Example, a target shape was formed in one step without forming the torsional shape portion 25, and press forming was performed by a method of crash forming by using pad (pad forming), in which the top portion was held with a pad (pressure pad). Next, as Example of the present invention, using the press forming tool 13 described in the embodiment, press forming is performed, including steps of: an initial forming step S3 of forming the flange portion 5 in the convex outer edge part 11*a* and forming the torsional shape portion 25 in the connecting outer edge part 11*c*; and a late forming step S5 of forming the torsional shape portion 25 into the flange portion 5 and forming the flange portion 5 in the concave outer edge part 11*b*. All the forming steps include a method of crash forming by using pad, in which the top portion was held with a pad.

In the case of Comparative Example, wrinkles occurred in portion a and fractures occurred in portion b illustrated in FIG. 14, and the target shape was not successfully obtained. In contrast, in Example of the present invention, the press forming part of high quality was successfully obtained with no fracture or wrinkles in the flange portion 5. As described above, the present invention is proven to be effective for suppressing stretch flange fracture and shrink flange wrinkles in formation of a press forming part having convex and concave parts in the in-plane direction on the top portion 3.

INDUSTRIAL APPLICABILITY

According to the present invention, it is possible to provide a press forming tool and a method of press forming applicable to a press forming part having an occurrence of wrinkles and fractures in a flange itself and capable of simultaneously suppressing the wrinkles and fractures occurring in the flange.

REFERENCE SINGS LIST

1 PRESS FORMING PART
3 TOP PORTION
5 FLANGE PORTION
7 CONVEX PART
9 CONCAVE PART
11 CONVEX AND CONCAVE OUTER EDGE PART
11*a* CONVEX OUTER EDGE PART
11*b* CONCAVE OUTER EDGE PART
11*c* CONNECTING OUTER EDGE PART
13 TOOLS OF PRESS FORMING
15 UPPER DIE
15*a* CONVEX OUTER EDGE FLANGE FORMING PORTION
15*b* CONCAVE OUTER EDGE FLANGE FORMING PORTION
15*c* CONNECTING OUTER EDGE FLANGE FORMING PORTION
17 LOWER DIE
19 BLANK
21 LOWER PAD
21*a* LOWER PAD CONVEX OUTER EDGE FLANGE FORMING PORTION
21*b* LOWER PAD CONCAVE OUTER EDGE FLANGE FORMING PORTION
21*c* LOWER PAD CONNECTING OUTER EDGE FLANGE FORMING PORTION
23 UPPER PAD
25 TORSIONAL SHAPE PORTION

The invention claimed is:

1. A press forming tool for forming a press forming part, the press forming part including: a top portion having a convex and concave outer edge part in which a convex outer edge part protruding outward in an in-plane direction and a concave outer edge part recessed inward in the in-plane direction are continuous to each other via a connecting outer edge part; and a flange portion continuously formed in the convex and concave outer edge part of the top portion, the press forming tool comprising:

an upper die and a lower die to be used for bend-forming of the flange portion along the convex and concave outer edge part; and a lower pad and an upper pad configured to sandwich a blank in cooperation with the upper die and the lower die, wherein the upper die includes:

a convex outer edge flange forming portion configured to form the flange portion in the convex outer edge part;

a concave outer edge flange forming portion configured to form the flange portion in the concave outer edge part; and a connecting outer edge flange forming portion configured to form the flange portion in the connecting outer edge part, the convex outer edge flange forming portion protruding in a press forming direction from the concave outer edge flange forming portion, with the connecting outer edge flange forming portion inclined from the convex outer edge flange forming portion toward the concave outer edge flange forming portion, the lower pad has a shape corresponding to each of the convex outer edge flange forming portion, the concave outer edge flange forming portion, and the connecting outer edge flange forming portion formed in the upper die, and press forming is performed such that during an initial stage of forming, the flange portion is formed on the convex outer edge part by the convex outer edge flange forming portion, and a torsional shape portion having a torsional shape toward the concave outer edge part is formed continuously from the flange portion by the connecting outer edge flange forming portion, and during a late stage of forming, the torsional shape portion is formed into the flange portion by the connecting outer edge flange forming portion, and the flange portion is formed in the concave outer edge part by the concave outer edge flange forming portion so as to achieve formation of a target shape.

2. A method of press forming for forming a press forming part by using the press forming tool according to claim 1, the press forming part including: a top portion having a convex and concave outer edge part in which a convex outer edge part protruding outward in an in-plane direction and a concave outer edge part recessed inward in the in-plane direction are continuous to each other via a connecting outer edge part; and a flange portion continuously formed on the convex and concave outer edge part of the top portion, the method of press forming comprising:

an initial forming step of forming the flange portion in the convex outer edge part by the convex outer edge flange forming portion and forming a torsional shape portion having a torsional shape toward the concave outer edge part by the connecting outer edge flange forming portion so as to be continuous from the flange portion, by moving the upper die in a press forming direction in a state where a part of a blank is sandwiched by the upper pad and the lower die and a part of the blank is supported by the lower pad; and a late forming step of moving the upper die and the lower pad in the press forming direction to form the torsional shape portion into the flange portion by the connecting outer edge flange forming portion and to form the flange portion in the concave outer edge part by the concave outer edge flange forming portion so as to achieve formation of a target shape.

* * * * *